United States Patent [19]

Woodman

[11] Patent Number: 4,862,968

[45] Date of Patent: Sep. 5, 1989

[54] PORTABLE FIRE EXTINGUISHER

[75] Inventor: Stuart D. Woodman, Markham, Canada

[73] Assignee: Chubb Fire Security division of Racal-Chubb Canada Inc., Toronto, Canada

[21] Appl. No.: 141,921

[22] Filed: Jan. 11, 1988

[30] Foreign Application Priority Data

Jan. 16, 1987 [CA] Canada ..... 527,495

[51] Int. Cl.[4] ..... A62C 23/08; A62C 23/10; A62C 23/00

[52] U.S. Cl. ..... 169/75; 169/89; 116/272; 222/402.11

[58] Field of Search ..... 169/71, 75, 76, 89; 16/DIG. 13; 116/272; 222/402.11, 153

[56] References Cited

U.S. PATENT DOCUMENTS

| | | | |
|---|---|---|---|
| 3,209,949 | 10/1965 | Gurtler | 169/89 X |
| 3,642,179 | 2/1972 | Micallef | 222/402.11 X |
| 3,667,549 | 6/1972 | Sachs et al. | 169/71 |
| 3,738,311 | 6/1973 | Appleton | 116/272 |
| 3,814,298 | 6/1974 | Hansen | 169/75 X |
| 4,067,482 | 1/1978 | Vogel et al. | 222/402.11 X |
| 4,119,153 | 10/1978 | Avant | 169/89 X |
| 4,142,650 | 3/1979 | Almouli | 222/402.11 X |
| 4,427,134 | 1/1984 | Almouli | 222/402.11 X |
| 4,449,647 | 5/1984 | Reed et al. | 222/153 |
| 4,512,278 | 4/1985 | Winther | 116/272 X |
| 4,619,328 | 10/1986 | Seyler et al. | 169/75 |
| 4,684,037 | 8/1987 | Gnutti et al. | 169/71 X |

FOREIGN PATENT DOCUMENTS

| | | | |
|---|---|---|---|
| 3609499 | 9/1987 | Fed. Rep. of Germany | 169/75 |
| 915949 | 1/1963 | United Kingdom | 169/75 |
| 1359497 | 7/1974 | United Kingdom | 169/75 |

*Primary Examiner*—Joseph F. Peters, Jr.
*Assistant Examiner*—James M. Kannofsky
*Attorney, Agent, or Firm*—Ridout & Maybee

[57] ABSTRACT

A portable disposable fire extinguisher comprises a container for fire extinguishing medium, a discharge head, and a valve device within the discharge head for controlling a discharge passage. The valve is normally biased to a closed position by a return spring and by pressure in the container. The discharge head is constituted by a one-piece moulding providing a valve body, a carrying handle, a discharge nozzle and an operating lever which is connected to the valve body by a plastic hinge. Accidental operation of the lever is prevented by a discardable stop plate forming part of the moulding and connected thereto by frangible connections.

9 Claims, 2 Drawing Sheets

PORTABLE FIRE EXTINGUISHER

FIELD OF THE INVENTION

This invention relates to fire extinguishers and is concerned, particularly with portable fire extinguishers of the kind including a container for fluent fire extinguishing medium stored under pressure, a discharge head thereon, and valve means within the discharge head adapted to control a discharge passage. The valve means comprises a valve member which is normally biased to a closed position to prevent discharge of the container contents but which can be operated manually to effect discharge. Means to prevent accidental discharge are usually provided.

The present invention is primarily concerned with portable fire extinguishers which are intended to be discarded after use, as distinguished from those which are intended to be recharged. It is important that such fire extinguishers should be economical to manufacture while being no less reliable than others.

It is an object of the present invention to provide a discharge head assembly for such a fire extinguisher which is both economical and reliable.

SUMMARY OF THE INVENTION

According to one aspect of the present invention, in a fire extinguisher of the kind referred to above the discharge head is constituted by a one-piece plastic moulding defining a valve body, coupling means at one end of the valve body operatively connecting the valve body to the container, a carrying handle projecting laterally from one side of the valve body, a discharge nozzle projecting laterally from the other side of the valve body, an operating lever connected to the other end of the valve body by a plastic hinge and extending laterally across said other end in spaced relation to the carrying handle, and a stop plate extending between the lever and the carrying handle and connected thereto by frangible connections whereby to prevent accidental operation of the lever, said lever when operated being engageable with said valve means whereby to displace the valve member from its closed position and so effect discharge of the fluent fire extinguishing medium.

According to another aspect of the invention, there is provided in a fire extinguisher of the kind referred to above a valve body having a longitudinally extending bore therethrough, said bore communicating with the container and providing an internal downwardly facing valve seat, a nozzle projecting laterally from the valve body and having an internal discharge passage communicating with the bore on the downstream side of the valve seat, a valve member slidably located in the bore in sealing engagement therewith, the valve member providing a closure member engageable with the valve seat in the closed position of the valve member and a plunger extending upwardly therefrom and projecting from the upper end of the bore, an operating lever hingedly connected to the valve body at its upper end, said lever being operable to engage the projecting end of the valve plunger for displacing the valve member from its closed position, and means for preventing accidental operation of the lever.

BRIEF DESCRIPTION OF THE DRAWINGS

Two preferred embodiments of the invention will now be described, by way of example, with reference to the accompanying drawings, in which.

DESCRIPTION OF THE PREFERRED EMBODIMENTS

Figures 1, 2, 3:
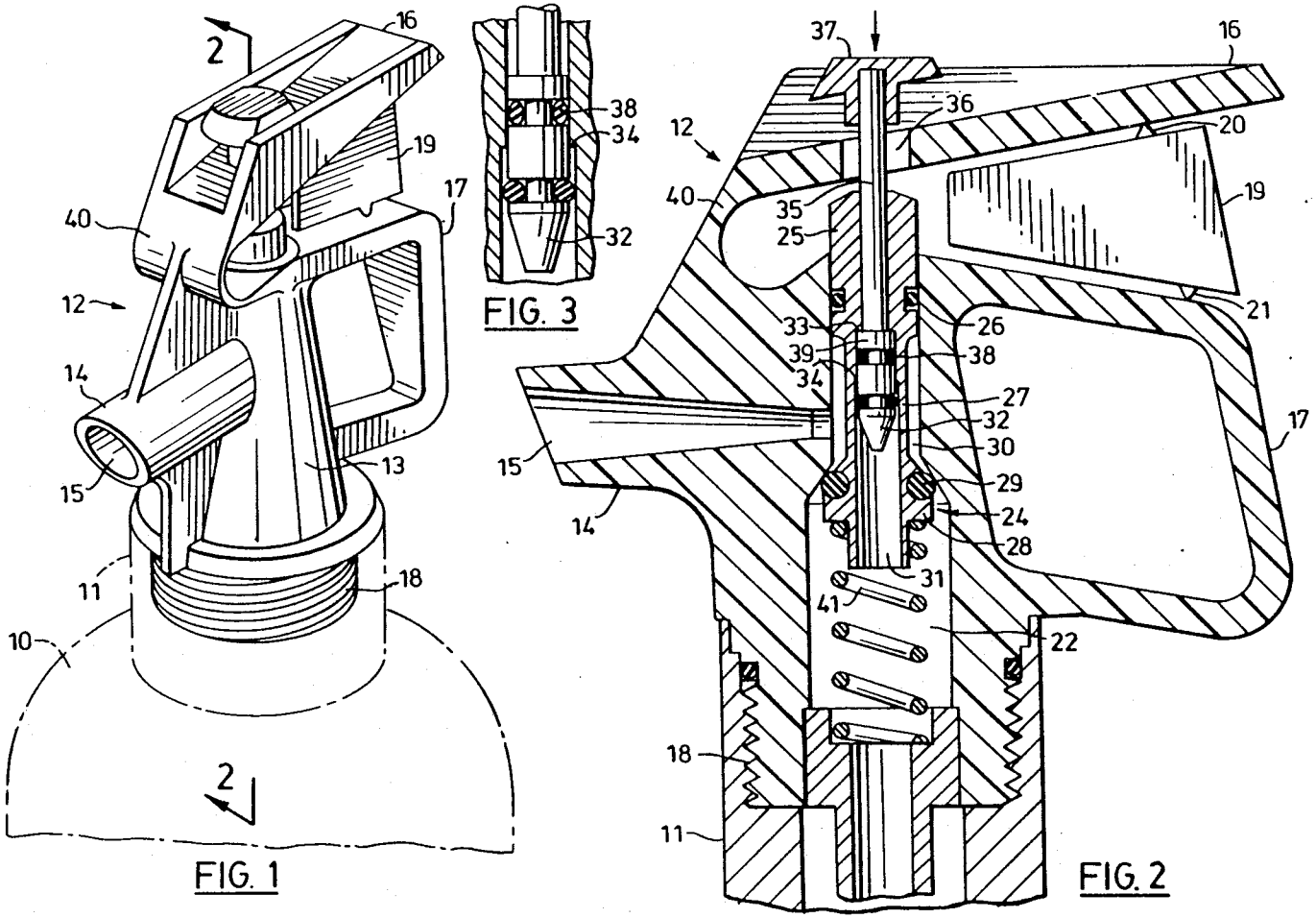
FIG. 1 is a perspective view of the discharge head assembly fitted to a container in which fluent fire extinguishing medium is stored under pressure.
FIG. 2 is a longitudinal sectional view taken on line 2—2 in FIG. 1.
FIG. 3 shows a detail of FIG. 2.

Referring to FIGS. 1–3 of the drawings, the fire extinguishing medium is stored in a cylinder 10 having a neck portion 11 which is internally threaded to receive the discharge head 12. The discharge head itself is constituted by a one-piece plastic moulding which provides a valve body portion 13, a discharge nozzle 14 having a discharge passage 15, a valve operating lever 16, and a carrying handle 17. The lower end of the valve body portion 13 is formed with an externally threaded spigot 18 by which the discharge head is securely coupled to the neck 11 and the cylinder 10. The valve operating lever 16, which is integrally connected with the other end of the valve body by a plastic hinge 40 so as to be pivotable about a horizontal axis, extends laterally across said other end of the valve body in spaced relation to the carrying handle 17. It will be seen that the carrying handle 17 and the discharge nozzle 14 project laterally from opposite sides of the valve body 13.

In order to prevent accidental operation of the lever 16, a stop plate 19 is interposed between the lever and the carrying handle 17. The stop 19 is itself also an integral part of the one-piece plastic moulding constituting the discharge head 12, and is joined both to the carrying handle 17 and the valve operating lever 16 by frangible connections 20, 21 which can easily be broken for the purpose of discarding the stop plate 19 when the fire extinguisher is to be used.

The valve body 13 has a longitudinally extending bore 22. This bore provides a first portion, or inlet portion, which extends from the lower end of the valve body so as to receive fire extinguishing medium from the cylinder 10 and terminates in an annular valve seat 23. The bore 22 also provides a second longitudinally extending portion of reduced diameter, which extends from the first bore portion to the other end of the valve body. The bore 22 accommodates a valve member 24 which is operable to control the supply of fire extinguishing medium to the discharge passage 15.

The valve member 24 comprises a plunger 25 which is slidably located in the reduced diameter portion of the bore 22 so as to be in sealing contact with the wall of said portion of the bore. For this purpose the plunger accommodates an O-ring seal 26. The valve member 24 also comprises a reduced diameter stem portion 27 which extends downwards from the plunger 25 and terminates in a closure member 28 fitted with an O-ring seal 29. The valve member is normally biased into its closed position by cylinder pressure and by the force of a return spring 41, the closure member 28 with its seal firmly engaging the valve seat 23. In this closed position the upper end of plunger 25 projects from the bore 22 at the upper end of the valve body, as shown in FIG. 2.

The stem portion 27 of the valve member defines with the inner wall of the bore 22 an annular valve chamber 30 with which the discharge passage 15 communicates. In order to operate the fire extinguisher, therefore, it is first necessary to discard the stop plate 19 by breaking the frangible connections 20, 21. The operating lever 16 can then be depressed manually so as to engage the projecting end of the sliding plunger 25 and so displace the valve member 28 from its closed position. With the closure member 28 removed from the valve seat 23, fire extinguishing medium under pressure can flow directly from the inlet portion of the bore 22 to the discharge passage 15 of the nozzle 14.

The valve member 24 is formed with a longitudinally extending stepped bore 31 which houses a probe member 32. The probe member 32 is also normally biased to the closed position by cylinder pressure.

The wall of the bore 31 has two annular steps 33 and 34, which define a first inlet portion at the lower end of the bore which is exposed to cylinder pressure, a second, intermediate bore portion of slightly reduced diameter, and a terminal portion of still further reduced diameter through which an actuating plunger 35 extends. The actuating plunger 35 also extends upwardly through a clearance opening 36 in the operating lever 16, and a press button 37 is fitted at its upper end. The probe member 32, fitted with an O-ring seal 38, is shown in FIG. 2 in its normal closed position. In this position the probe member 32 and seal 38 are located in the intermediate portion of the bore 31 and make sealing contact with the wall of said intermediate bore portion. As previously mentioned, the probe member is normally biased to this position by cylinder pressure, upward movement being limited by an abutment flange 39 on the plunger 35 which engages the annular step 33. By depressing the plunger 35, however, the probe member 32 and seal 38 are moved past the lower stop. If the cylinder 10 is charged the probe member is returned to its normal closed position upon release of the press button 37, and the return of the press button to its original position indicates to the user that the cylinder is adequately charged. However, if the cylinder pressure has fallen below the acceptable minimum value, the member remains in its displaced position and the button 37 remains depressed.

Figures 4, 5:
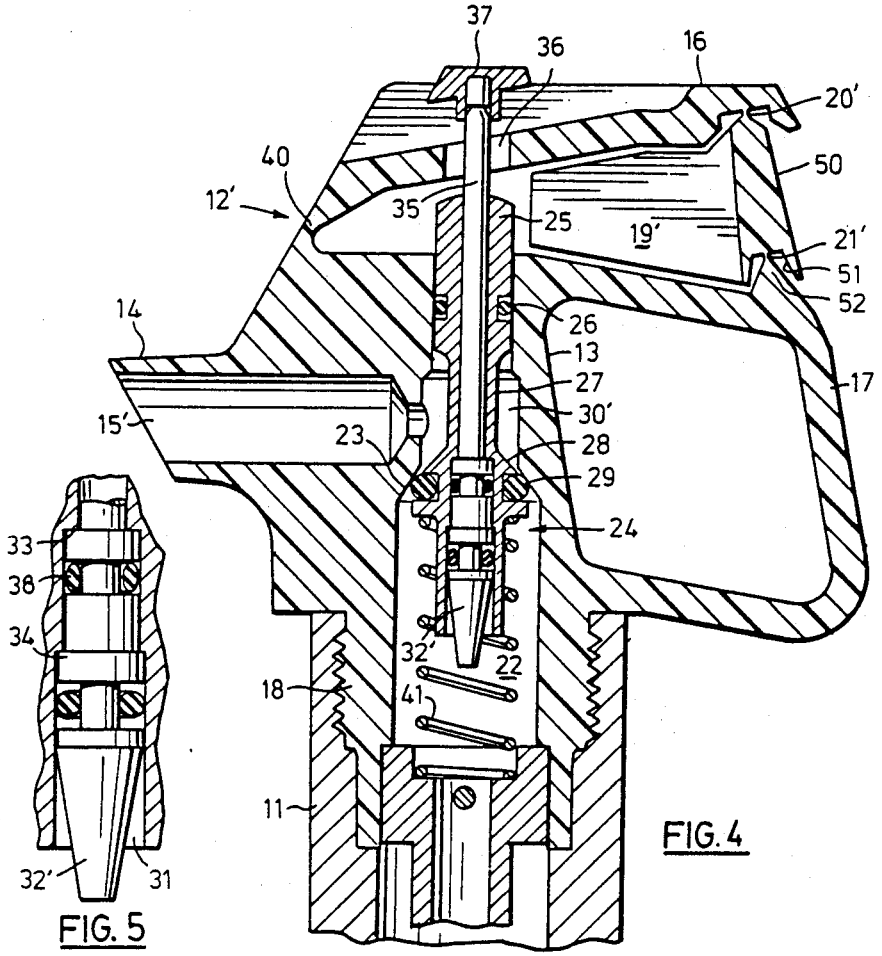
FIG. 4 is a longitudinal sectional view, corresponding to FIG. 2, of a modified discharge head assembly.
FIG. 5 shows a detail of FIG. 4.

The improved embodiment of the invention illustrated in FIGS. 4 and 5 is basically the same as that shown in FIGS. 1–3, and corresponding parts are denoted by the same reference numerals. However, corresponding parts which have been modified, thereby to provide an even more efficient discharge head design, are denoted by primed reference numerals. In this second fire extinguisher, the fire extinguishing medium is stored in a cylinder having a neck portion 11 which is internally threaded to receive the discharge head 12'. The discharge head itself is constituted by a one-piece plastic moulding which provides a valve body portion 13, a discharge nozzle 14 having a cylindrical discharge passage 15', a valve operating lever 16, and a carrying handle 17. The lower end of the valve body portion 13 is formed with an externally threaded spigot 18 by which the discharge head is securely coupled to the neck 11 and the cylinder. The valve operating lever 16, which is integrally connected with the other end of the valve body by a plastic hinge 40 so as to be pivotable about a horizontal axis, extends laterally across said other end of the valve body in spaced relation to the carrying handle 17. It will be seen that the carrying handle 17 and the discharge nozzle 14 project laterally from opposite sides of the valve body 13.

In order to prevent accidental operation of the lever 16, a stop plate 19' is interposed between the lever and the carrying handle 17. The stop plate 19' is itself also an integral part of the one-piece plastic moulding constituting the discharge head 12, and is joined both to the carrying handle 17 and the valve operating lever 16 by frangible connections 20', 21' which can easily be broken for the purpose of discarding the stop plate 19' when the fire extinguisher is to be used.

In this embodiment the stop plate 19' extends generally in the plane of the handle 17 and is formed with an integral, laterally extending flange 50 positioned for engagement by the thumb of the user. The lower edge of the flange 50 is formed with a Vee groove 51 into which a correspondingly shaped protruding edge 52 of the handle 17 extends. The frangible connections 20', 21' are aligned so as to define a generally vertical axis such that, when the flange 40 is engaged by the user's thumb and pressed, the stop plate 19' is rotated so as to twist and break the connections. The valve operating lever can then be depressed. When the stop plate is rotated, the edge 52 engages one side of the groove 51 thereby preventing further rotation unless sufficient force is applied to the stop plate, thereby preventing accidental operation. On the other hand, if sufficient force is applied to the stop plate, the engagement of the edge 52 with one side of the groove 51 effects a camming action whereby a tensile force is applied to the frangible connections 20', 21' causing the latter to break as they are twisted.

The valve body 13 has a longitudinally extending bore 22. This bore provides a first portion, or inlet portion, which extends from the lower end of the valve body so as to receive fire extinguishing medium from the cylinder 10 and terminates in an annular valve seat 23. The bore 22 also provides a second longitudinally extending portion of reduced diameter, which serves as a guide for the valve plunger 25, and extends to the other end of the valve body, and also an intermediate portion 30' of intermediate diameter forming a valve chamber communicating with the discharge passage 15'. The bore 22 accommodates a valve member 24 which is operable to control the supply of fire extinguishing medium to the discharge passage 15'.

The valve member 24 comprises the plunger 25 which is slidably located in the reduced diameter portion of the bore 22 so as to be in sealing contact with the wall of said portion of the bore. For this purpose the plunger accommodates an O-ring seal 26. The valve member 24 also comprises a reduced diameter stem portion 27 which extends downwards from the plunger 25 and terminates in a closure member 28 fitted with an O-ring seal 29. The valve member is normally biased into its closed position by cylinder pressure and by the force of a return spring 41, the closure member 28 with its seal firmly engaging the valve seat 23. In this closed position the upper end of the plunger 25 projects from the bore 22 at the upper end of the valve body, as shown in FIG. 4.

In order to operate the fire extinguisher, therefore, it is first necessary to discard the stop plate 19' by breaking the frangible connections 20', 21'. The operating lever 16 can then be depressed manually so as to engage the projecting end of the sliding plunger 25 and so displace the valve member from its closed position. With the closure member 28 removed from the valve seat 23, fire extinguishing medium under pressure can flow directly from the inlet portion of the bore 22 to the discharge passage 15 of the nozzle 14.

As in the first embodiment, the valve member 24 is formed with a longitudinally extending stepped bore 31 which houses a probe member 32'. The probe member 32' is also normally biased to the closed position by cylinder pressure.

The wall of the bore 31 has two annular steps 33 and 34, which define a first inlet portion at the lower end of the bore which is exposed to cylinder pressure, a second, intermediate bore portion of slightly reduced diameter, and a terminal portion of still further reduced diameter through which an actuating plunger 35 extends. The actuating plunger 35 also extends upwardly through a clearance opening 36 in the operating lever 16, and a press button 37 is fitted at its upper end. The probe member 32', fitted with an O-ring seal 38, is shown in FIG. 4 in its normal closed position. In this position the probe member 32' and seal 38 are located in the intermediate portion of the bore 31 and make sealing contact with the wall of said intermediate bore portion. As previously mentioned, the probe member is normally biased to this position by cylinder pressure, upward movement being limited by an abutment flange 39 on the plunger 35 which engages the annular step 33. By depressing the plunger 35, however, the probe member 32' and seal 38 are moved past the lower stop. If the cylinder is charged the probe member is returned to its normal closed position upon release of the press button 37, and the return of the press button to its original position indicates to the user that the cylinder is adequately charged. However, if the cylinder pressure has fallen below the acceptable minimum value, the probe member remains in its displaced position and the button 37 remains depressed.

I claim:

1. A portable fire extinguisher comprising a container for fluent fire extinguishing medium stored under pressure, a discharge head thereon, and valve means within the discharge head operable to control a discharge passage, said valve means including a valve member which is normally biased to a closed position to prevent discharge, wherein the discharge head is constituted by a one-piece plastic moulding defining a valve body, coupling means at one end of the valve body operatively connecting the valve body to the container, a carrying handle projecting laterally from one side of the valve body, a discharge nozzle projecting laterally from the other side of the valve body, an operating lever connected to the other end of the valve body by a plastic hinge and extending laterally across said other end in spaced relation to the carrying handle, and a stop plate extending between the lever and the carrying handle and connected thereto by frangible connections whereby to prevent accidental operation of the lever, said lever when operated being engageable with said valve means whereby to displace the valve member from its closed position and so effect discharge of the fluent fire extinguishing medium.

2. A portable fire extinguisher according to claim 1, wherein the valve body is formed with a longitudinally extending bore communicating with the container and said discharge passage, the valve member being located in said bore and being normally biased to a closed position at which it blocks communication between the container and said discharge passage, the valve member being displaceable from its closed position by operation of said lever.

3. A portable fire extinguisher according to claim 2, wherein the valve member has a lever-engaging portion projecting from the bore at said other end of the valve body.

4. A portable fire extinguisher according to claim 1, wherein the valve body is formed with a longitudinal bore therein, said bore providing a first, inlet portion extending from said one end of the valve body and terminating in a valve seat, and a second bore portion of reduced diameter extending from the first bore portion to said other end of the valve body, and wherein said valve member comprises a plunger which is slidably located in said second bore portion in sealing engagement therewith, the plunger having a longitudinally extending stem portion terminating in a closure member which engages the valve seat in the closed position of the valve member, said stem portion defining with the wall of the second bore portion a valve chamber, and said discharge passage communicating with the valve chamber.

5. A portable fire extinguisher according to claim 4, wherein the plunger projects from said second bore portion in the closed position of the valve member, the operating lever being engageable when operated with the projecting end of the plunger.

6. A portable fire extinguisher according to claim 1, wherein the stop plate extends generally in the plane of the carrying handle.

7. A portable fire extinguisher according to claim 6, wherein the stop plate is formed with an integral, laterally extending flange positioned for engagement by the thumb of a user, said frangible connections being formed by sprues which are aligned in said plane of the carrying handle so as to form an axis about which the stop plate can be rotated for twisting and breaking said connections.

8. A portable fire extinguisher according to claim 7, wherein the lower edge of the stop plate is formed with a Vee groove into which a correspondingly shaped edge of the carrying handle extends and with which said correspondingly shaped edge of the handle engages when the stop plate is rotated about said axis.

9. In a portable fire extinguisher comprising a container for fire extinguisher medium stored under pressure, an improved discharge head assembly comprising, in combination:

a one-piece plastic moulding providing a valve body having a longitudinally extending bore therethrough, coupling means at one end of the valve body operatively connecting the body to the container, a carrying handle projecting from one side of the body, a discharge nozzle projecting from the other side of the body, the discharge nozzle having a discharge passage communicating with the bore, an operating lever connected to the other end of the valve body by a plastic hinge and extending laterally across said other end of the body in spaced relation to the carrying handle, and a stop plate extending between the lever and the carrying handle and connected thereto by frangible connections whereby to prevent accidental operation of the lever;

said longitudinally extending bore providing a first inlet bore portion extending from said one end of the valve body and terminating in a valve seat, and a second bore portion of reduced diameter extending from the first bore portion to said other end of the valve body;

a valve member located in the bore, the valve member comprising a plunger which is slidable along said second bore portion in sealing engagement therewith, and a stem extending from the plunger and terminating in a closure member which is engageable with the valve seat;

the valve member normally being biased to a closed position at which it sealingly engages the valve seat;

said stem defining with the wall of said second bore portion a valve chamber communicating with the discharge passage;

said plunger projecting from the bore at said other end of the valve body and being engageable by said lever, when operated, to displace the valve from its closed position thereby to effect discharge;

the valve member having a longitudinally extending central bore therein exposed to container pressure and housing a probe member slidably located in said central bore, the probe member being biased to a limit position by container pressure;

externally operable means connected to the probe member for displacing the probe member from said limit position; and indicator means connected to said externally operable means for indicating whether the probe member is returned to the limit position thereby to provide an indication that the container is charged.

* * * * *